US010264863B2

(12) United States Patent
Goerges

(10) Patent No.: US 10,264,863 B2
(45) Date of Patent: Apr. 23, 2019

(54) TRAY INSERT FOR HOLDING A SPECTACLE LENS DURING TRANSPORT

(71) Applicant: James Gregory Goerges, East Gull Lake, MN (US)

(72) Inventor: James Gregory Goerges, East Gull Lake, MN (US)

( * ) Notice: Subject to any disclaimer, the term of this patent is extended or adjusted under 35 U.S.C. 154(b) by 0 days.

(21) Appl. No.: 15/660,579

(22) Filed: Jul. 26, 2017

(65) Prior Publication Data

US 2019/0029381 A1 Jan. 31, 2019

(51) Int. Cl.
*A45C 11/04* (2006.01)
*A45C 13/02* (2006.01)

(52) U.S. Cl.
CPC ..... *A45C 11/04* (2013.01); *A45C 13/02* (2013.01)

(58) Field of Classification Search
CPC ..... A45C 11/04; A45C 11/046; A45C 11/06; A45C 13/02; A45C 11/043; A45C 2013/026
USPC ..... 206/5, 5.1; 211/85.1
See application file for complete search history.

(56) References Cited

U.S. PATENT DOCUMENTS 3,124,240 A * 3/1964 Croan ..... A45C 11/005 134/155
4,173,281 A * 11/1979 Trought ..... A61F 2/1691 206/210
4,269,307 A * 5/1981 LaHaye ..... A61F 2/1691 206/5.1
4,615,703 A * 10/1986 Callahan ..... A61F 2/1691 206/210
D382,399 S * 8/1997 Hambleton ..... D3/263
5,928,154 A * 7/1999 Silber ..... B25G 1/10 600/459
6,159,072 A * 12/2000 Shibata ..... B23Q 7/047 451/381
D612,057 S 3/2010 Meschenmoser et al.
D619,258 S * 7/2010 Meschenmoser ..... D24/172
8,490,781 B2 * 7/2013 Meschenmoser ..... B65D 85/38 206/5

* cited by examiner

*Primary Examiner* — Steven A. Reynolds
(74) *Attorney, Agent, or Firm* — David George Johnson

(57) ABSTRACT

The invention is an insert (1) for a tray (28) used for storing or conveying a spectacle lens (34, 35) and a spectacle frame (61). The insert (1) is mounted to engage various outward extensions (25, 26) formed as part of the tray floor (27). The insert (1) includes numerous beveled surfaces (45, 19, 43, 46, 40, 41, 42, 38, 39, 37, 36), at least some of which can engage a spectacle lens placed on the insert. A vulcanized rubber dispersed in a plastic matrix used to construct the insert (1). A frame pillow (60) is formed as a sheet (62) which overlays the tray floor (27), creating a space which reduces or eliminates movement of the spectacle frame (61) during tray transport.

4 Claims, 9 Drawing Sheets

TRAY INSERT FOR HOLDING A SPECTACLE LENS DURING TRANSPORT

TECHNICAL FIELD

The present invention pertains generally to the field of containers, and more particularly to structural members used to support lenses or other fragile objects during transport within a tray during a manufacturing operation.

DESCRIPTION OF RELATED TECHNOLOGY

Spectacle lenses are manufactured and processed in a factory environment involving numerous individual steps such as coating, blocking, edging, labeling and installing. Many other small and fragile parts undergo similar manufacturing steps. In order for these steps to be accomplished the lenses or other parts must be handled, manipulated and then transported from one place to another within the factory, with each event introducing the opportunity for the part to be damaged. In particular, a lens can be completely ruined by the presence of even a small scratch or chip, and so the most important requirement is to protect the integrity of the lens even at the cost of greater efficiency in the manufacturing process.

In the modern lens processing facility, lenses and other small parts are frequently placed in trays having standardized dimensions, the trays being adapted to fit on conveyors or other transport devices, and which can of course be carried from place to place by hand. A vexing problem has been placing the lens within the tray in a manner that will prevent damage to the part while still making possible the easy insertion and removal of the lens from the tray.

One attempt to address this problem is to simply insure that the trays move very slowly without encountering any abrupt maneuvers. While somewhat effective in protecting the lens, the speed of the entire manufacturing process suffers greatly from the requirement of slow speed lens transport. A further inherent problem is that some protective material or fixture must reside within the tray which can secure or otherwise protect the lens. For example, U.S. Pat. No. D612,057, entitled "Inlay for Transport Tray for Spectacle Lenses and Spectacle Lens Blank", utilizes a device that can be secured within a tray and which includes a series of sharp edged spaced apart buttresses which can support a lens in a horizontal position. The '057 device does not disclose a material of manufacture, but appears to be similar to other existing devices of this type that are so rigid that scratching, scuffing or other marring of the lens surface is possible. Further, the '057 device appears to constrain only a those having a very specific diameter, in which case the lens could easily be forcibly ejected from the device if the buttresses or the lens were slightly out of tolerance as might typically occur due to normal wear. The '057 device includes a series of sharp, projecting corners that are easily capable of abutting a portion of a lens during placement, transport and removal.

The need remains for a simple tray insert that may be easily manufactured in a configuration that can secure a variety of lens shapes without danger of damage even in situations where the lens is not perfectly placed within the tray insert.

SUMMARY OF THE INVENTION

Figure 1:
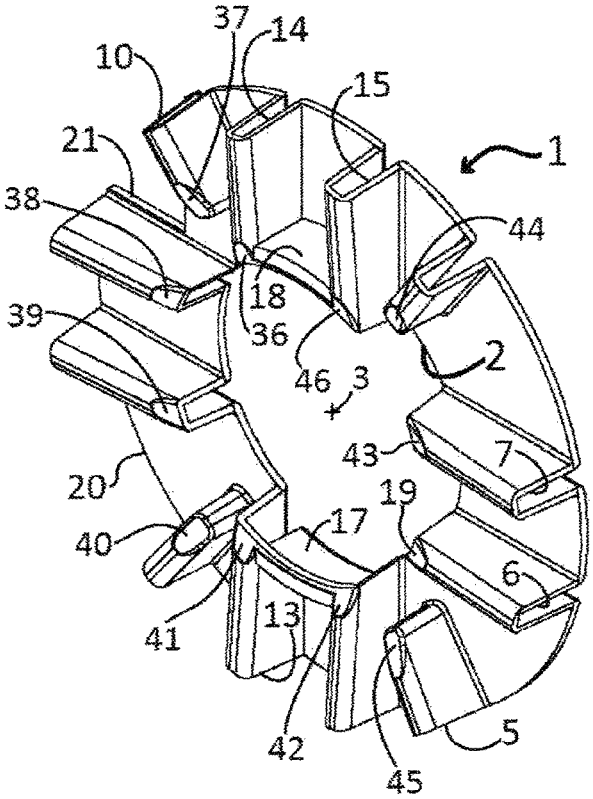
FIG. 1 is an isometric view of a tray insert constructed according to the principles of the present invention.

The present invention discloses an insert formed as a receptacle or mechanical support that is adapted to receive and constrain a spectacle lens or other fragile object that must be repeatedly handled or manipulated during a manufacturing, inspection or testing procedure. The present invention includes a base or foundation that is suitably shaped and dimensioned so that it will fit on or within a mating structure that has been formed on floor or bottom surface of a tray, palette or other fixture that is typically found within a manufacturing facility, the tray being adapted to be transported either by hand, a conveyor belt, a robot, a trolley or by a combination of the foregoing types of devices. The movement of the tray within a manufacturing facility ideally occurs as rapidly as possible but without causing any damage to the lens, including when the lens/tray combination or assembly is in motion or when the lens is being placed in or removed from the tray insert. Placement of the lens within the insert or removal of the lens from the insert may occur manually or robotically, and may occur when the tray is stationary or in motion. During transport, the tray may accelerate, decelerate, stop or be subjected to vibration. The present invention includes a tray insert that is molded or otherwise formed from a thermoplastic vulcanizate, that is, a vulcanized rubber dispersed in a plastic matrix. A suitable material is sold commercially under the trademark Santoprene, which is manufactured by Exxon-Mobil Chemical Company 13501 Katy Freeway, Houston, Tex. 77079, U.S.A. Three particular types of the Santoprene material are contemplated as suitable for the present invention, which are currently marketed under the product numbers 8211-45, 8211-55 and 8211-65. The suggested Santoprene materials have a Shore hardness value that is typically in the range of 49-59, which is sufficiently low to resist movement across its surface by abutting objects, and when such movement occurs the chance of marring or abrading the abutting object is slight.

The tray insert base is formed to include a series of channels, grooves and perforations that are adapted to fit within and mate to a corresponding pattern of ridges and abutments that exist within a standard parts handling tray as is typically found in a modern lens or parts manufacturing or processing facility. The durometer and coefficient of friction of the thermoplastic vulcanizate, along with the dimensional tolerances of the channels and grooves of the tray insert, is sufficient to bond the insert to the tray without tools or the use of substantial force. This provides a standardized way to place and remove parts, and the insert itself may easily be affixed or removed either manually or robotically as needed.

The upper portions or superstructure of the tray insert is formed to include a series of symmetrically spaced channels, ridges and bores that can accommodate and support various lens processing fixtures, such as edging blocks, as well as the lens itself. The entire tray insert is homogeneously composed of the thermoplastic vulcanizate, and so the superstructure possesses the same durometer and coefficient of friction as the base portion of the tray insert. The ridges that form portions of the superstructure can be formed to have various aspect ratios so as to create structural elements having desired ranges of stiffness and flexibility as well as absolute values of deflection or displacement. In this manner, the superstructure can retain the lens or a lens processing element while gripping the lens or element with sufficient force to prevent undesired displacement or ejection during transport. Further, the superstructure is sufficiently soft and pliable so to prevent gouging, scuffing or other abrasion of a lens residing within the tray insert of the present invention.

DETAILED DESCRIPTION OF THE INVENTION

Figure 2:
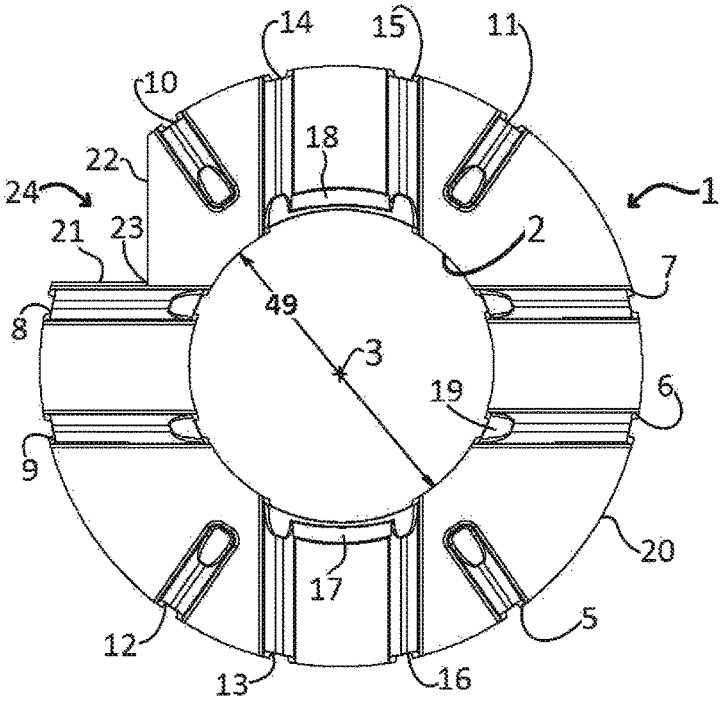
FIG. 2 is a top plan view of the tray insert illustrated in FIG. 1.
Figure 3:
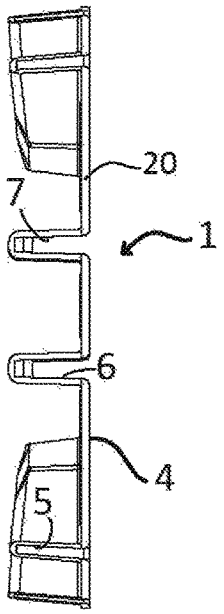
FIG. 3 is a side elevation view of the tray insert illustrated in FIG. 1.

Referring generally to FIGS. 1, 2 and 3, a first embodiment of a tray insert constructed according to the principles of the present invention is shown generally at 1. The tray insert 1 has a generally circular plan form that includes a generally circular opening or bore 2 surrounding the geometrical center 3. The bottom surface 4 is generally flat, but is formed to include a plurality of indentations, such as indentations 5, 6 and 7. Each indentation is formed as part of an oppositely aligned pair. For example, indentation 7 is aligned with indentation 8, while indentation 9. Similarly, indentation 5 is aligned with indentation 10, and indentation 11 is aligned with indentation 12.

Two additional pairs of aligned indentations are also provided. The indentation 13 is aligned with indentation 14, while indentation 15 is substantially aligned with indentation 16. The indentations 13 and 16 form a pair of substantially parallel indentations joined by a curved wall 17. Similarly, indentations 14 and 15 form a pair of substantially parallel indentations joined by a curved wall 18. Each indentation, such as indentation 6, for example, is formed to include a bevel or inclined end piece, such as bevel 19.

While the tray insert 1 is formed so as to have a substantially continuous perimeter 20, each indentation, such as indentations 6 and 10, for example, do cause a relatively small discontinuity in the circular perimeter shape. A relatively larger discontinuity is formed by orthogonal lines 21 and 22 which intersect at corner 23. The result of this geometry is to form a partial rectangular cutout.

Figure 4:
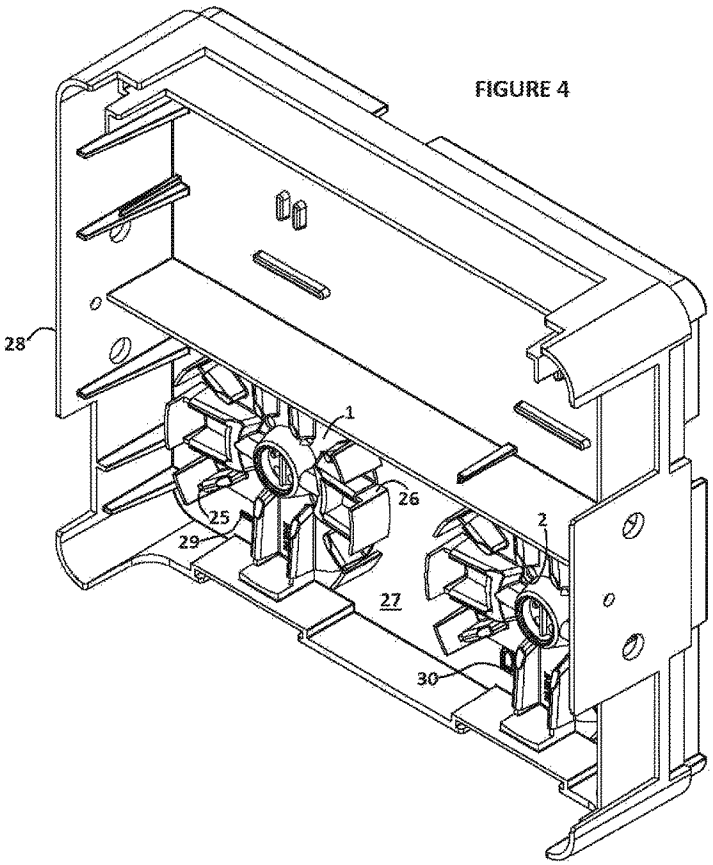
FIG. 4 is an isometric view of the tray insert illustrated in FIG. 1, shown mounted within a tray to form a lens support assembly.
Figure 5:
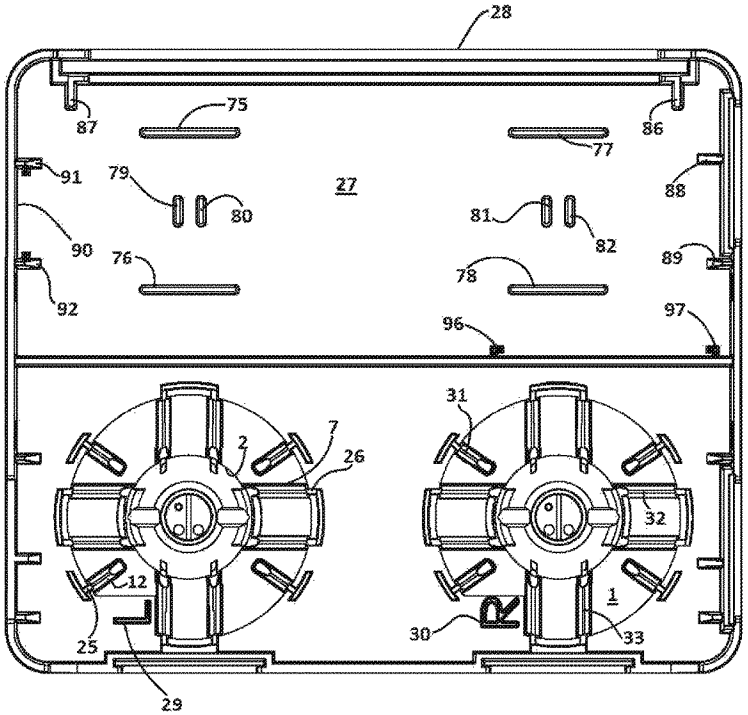
FIG. 5 is a top plan view of the lens support assembly depicted in FIG. 4.
Figure 6:
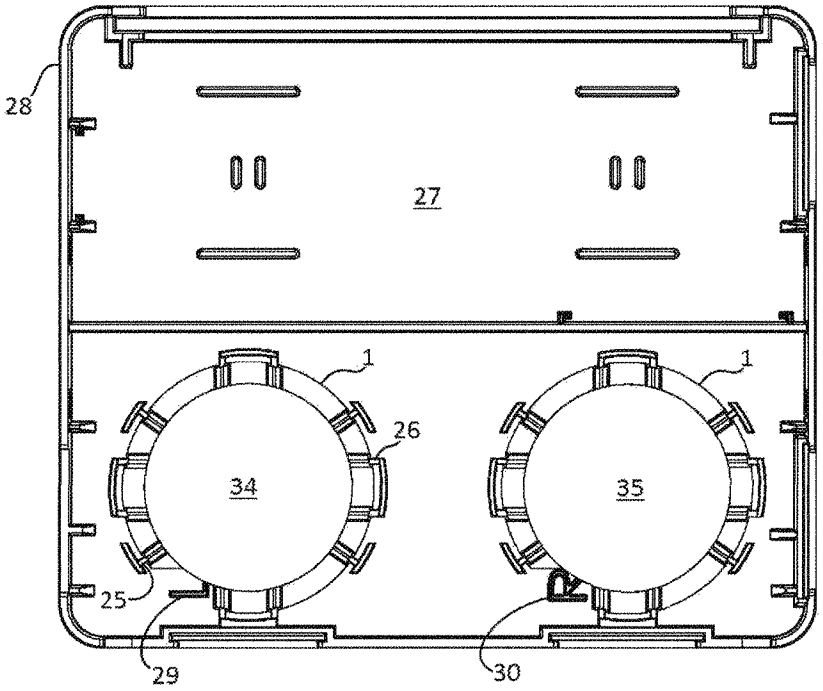
FIG. 6 is a top plan view of the lens support assembly illustrated in FIG. 4 with a lens present in each tray insert.

The tray insert 1 is formed to mate with a collection of raised structures, such as the vertical blades 25 and 26 depicted in FIGS. 4 and 5. The vertical blades are integrally formed with the floor 27 of the tray 28, and may be formed in a variety of shapes, geometrical patterns, sizes, number and dimensions. The tray insert 1 is formed to include a series of indentations adapted to mate with the raised structures extending from the tray floor 27. For example, the indentation 7 of the tray insert 1 is shaped and dimensioned so as to overlay and abut the vertical blade 26. Similarly, the indentation 12 is formed to have a suitable position and shape to mate with the vertical blade 25. Each indentation formed within the tray insert 1 is formed to include a slit or gap, such as gaps 31, 32 and 33, for example, which can receive a ridge, pin, tab or other protrusion that may be extend from an upper surface of the vertical blade 25. The Santoprene material surrounding the gap 31 is inherently capable of expanding or deforming to accept any relatively slender feature present on the vertical blade when placed over the vertical blade. Further, the gaps 31, 32, for example, provide some ability for each indentation 12 to expand so as to accommodate a relatively larger vertical blade if necessary.

In the preferred embodiments of the present invention, the floor 27 of tray 28 is marked with position designators 29 and 30, which are typically used to indicate a left or right orientation, but which could also be marked to indicate any other numerical order or geometrical relationship as appropriate for any particular manufacturing process. The tray floor 27 is marked directly to indicate that each tray insert 1 is identical regardless of the differences between the parts retained by the tray inserts.

Typically the present invention is used for the transport of a spectacle lens in a manufacturing or processing facility. Referring also to FIGS. 4, 5, 6 and 10, the tray 28 contains preformed structural elements such as the vertical blades 25 and 26 which support the tray inserts 1. Each tray insert 1 supports a lens. The left lens 34 is placed adjacent to the left icon 29 and the right lens 35 is placed adjacent to the right icon 30.

Each lens is supported in an approximately horizontal position by a series of beveled surfaces. As portrayed in FIG. 1, the insert 1 includes beveled surfaces 36, 37, 38, 39, 40, 41, 42, 19, 43, 44, 45 and 46. When the lens 34 is placed in the insert 1, some portions of the surface of the lens will abut at least some and almost certainly most if not all of the beveled surfaces 19 and 36-45. The orientation of the lens 34 will not necessarily be substantially horizontal but will typically be within twenty degrees of a plane that is parallel to the bottom surface 27 of the tray 28.

Figure 7:
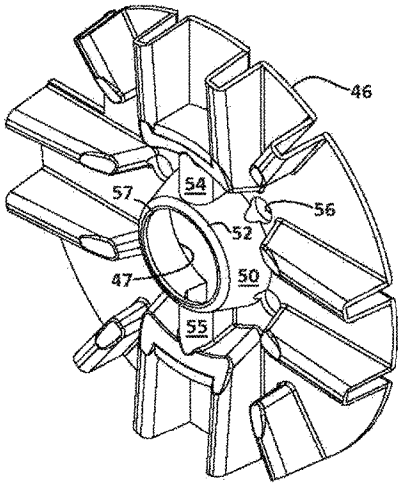
FIG. 7 is an isometric view of a second embodiment of a tray insert constructed according to the principles of the present invention.
Figure 9:
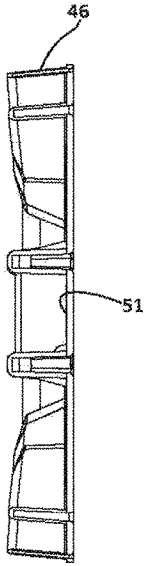
FIG. 9 is a side elevation view of the tray insert illustrated in FIG. 7.
Figure 8:
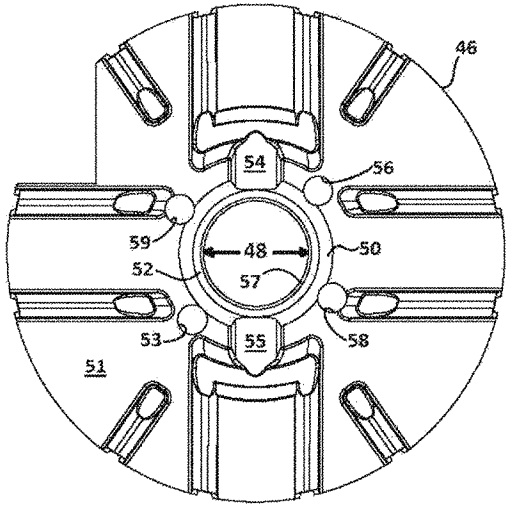
FIG. 8 is a top plan view of y insert illustrated in FIG. 7.
Figure 10:
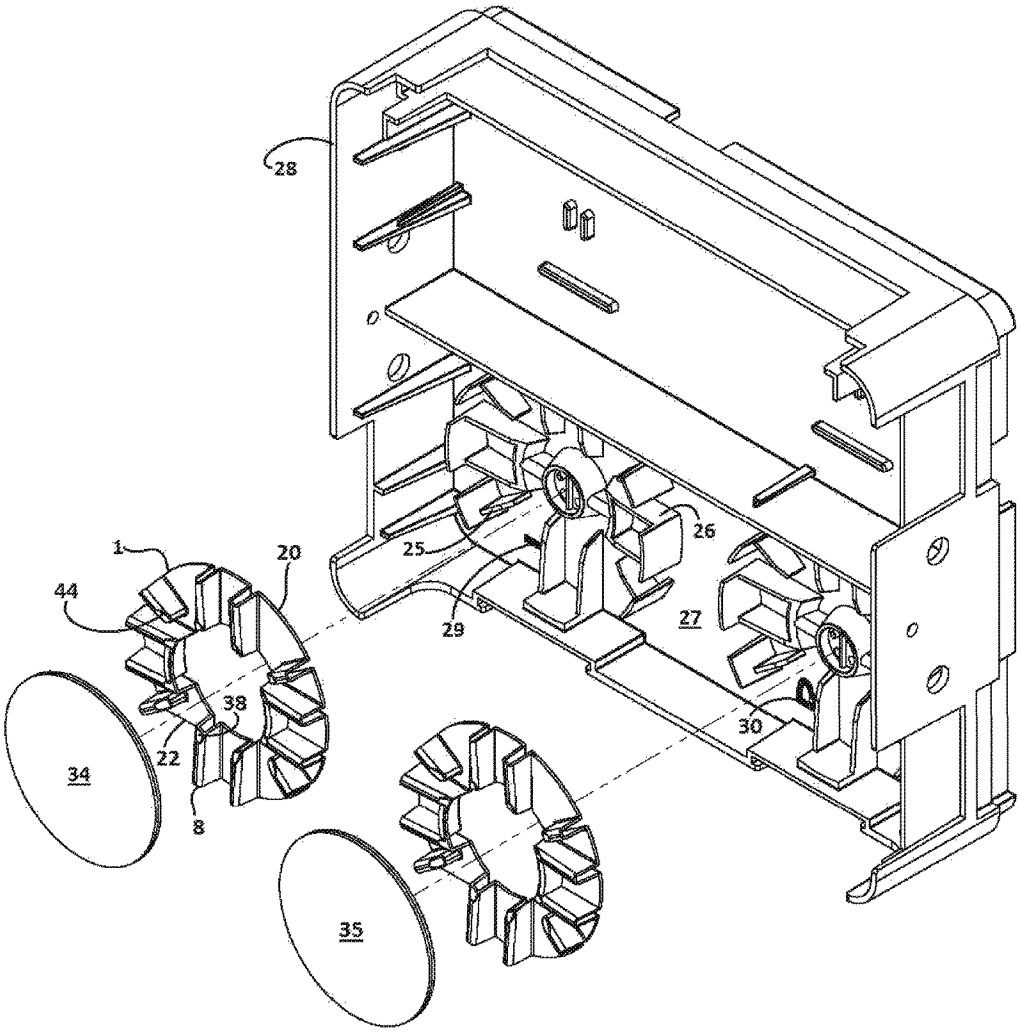
FIG. 10 is an exploded view of the lens and lens support assembly illustrated in FIG. 6.

A second embodiment of the present invention is depicted in FIGS. 7, 8 and 9, which discloses a tray insert 46 having a central opening 47 with a relatively reduced diameter 48. The diameter 49 of tray insert 1 is approximately 1.72 inches, while the diameter 48 of tray insert 46 is approximately 0.72 inches. The tray insert 46 is able to support a relatively smaller or irregularly shaped article and includes several structural features to accomplish this task. The central opening 47 is surrounded by a tapered column 50 that is integrally formed with the planar base 51 of the tray insert 46. Adjacent to the central opening 47 the tapered column 50 transitions to a bevel 52 which terminates at a substantially horizontal annular shelf 57. Stiffeners 54 and 55 are integrally formed with the tapered wall 50, the stiffeners being adapted to overlay and abut vertical extensions or other structures that may extend from the planar floor 27 of the tray 28. A series of perforations 53, 56, 58 and 59 are formed in the planar base 51 to accommodate vertical pegs or other protrusions that may extend from the from the planar floor 27 of the tray 28.

Figure 11:
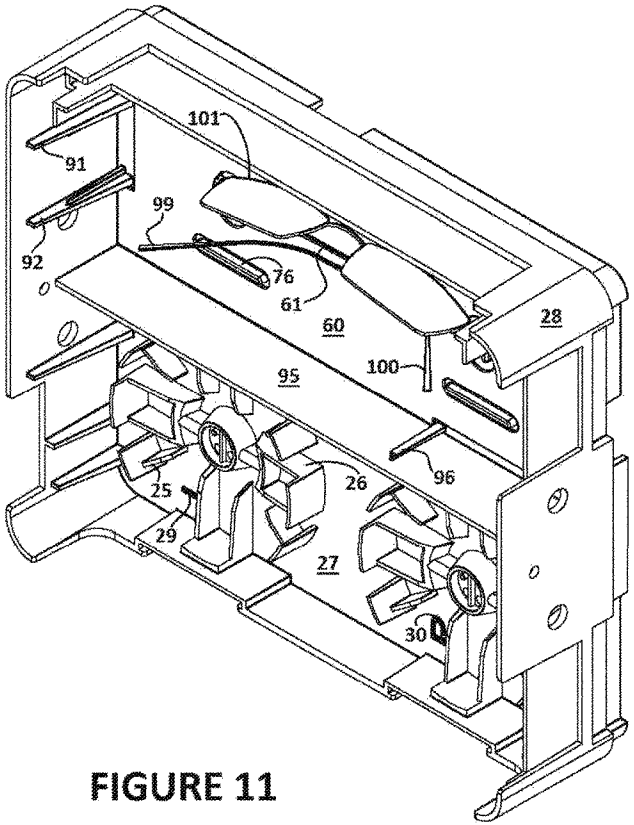
FIG. 11 is an isometric view of a frame pillow constructed according to the principles of the present invention, shown mounted in the tray depicted in FIG. 1 without tray inserts and depicting the frame pillow supporting a spectacle frame.
Figure 12:
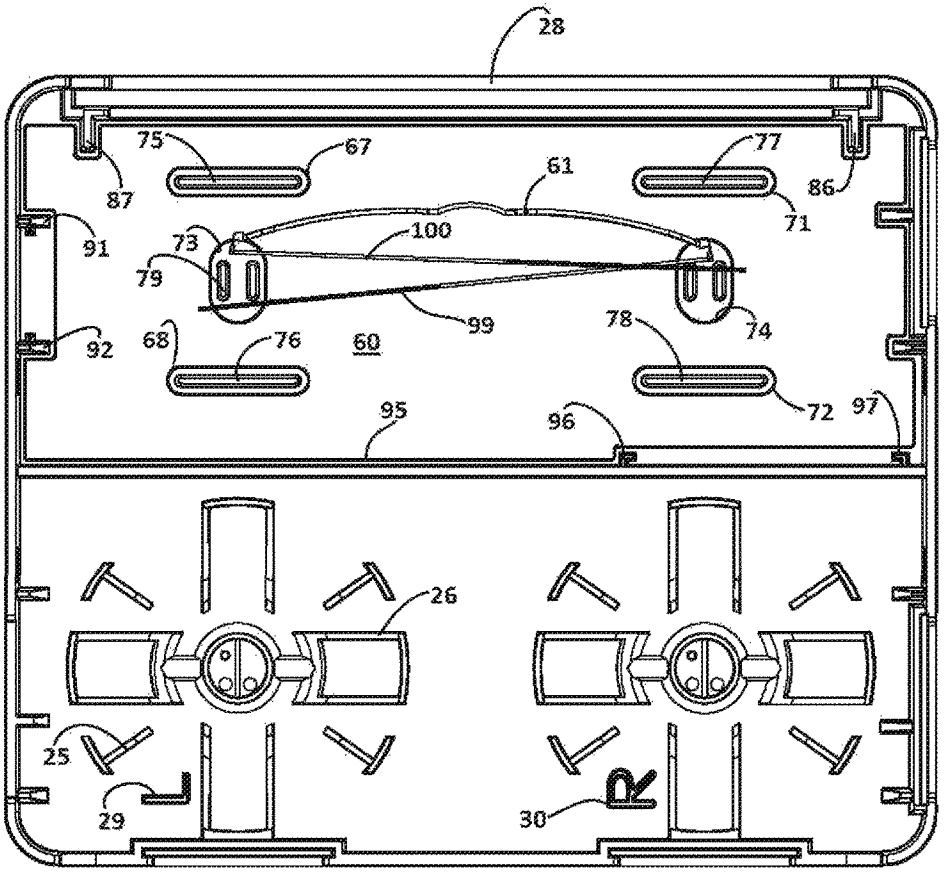
FIG. 12 is a top plan view of the frame pillow mounted in the tray as depicted in is FIG. 11.
Figure 13:
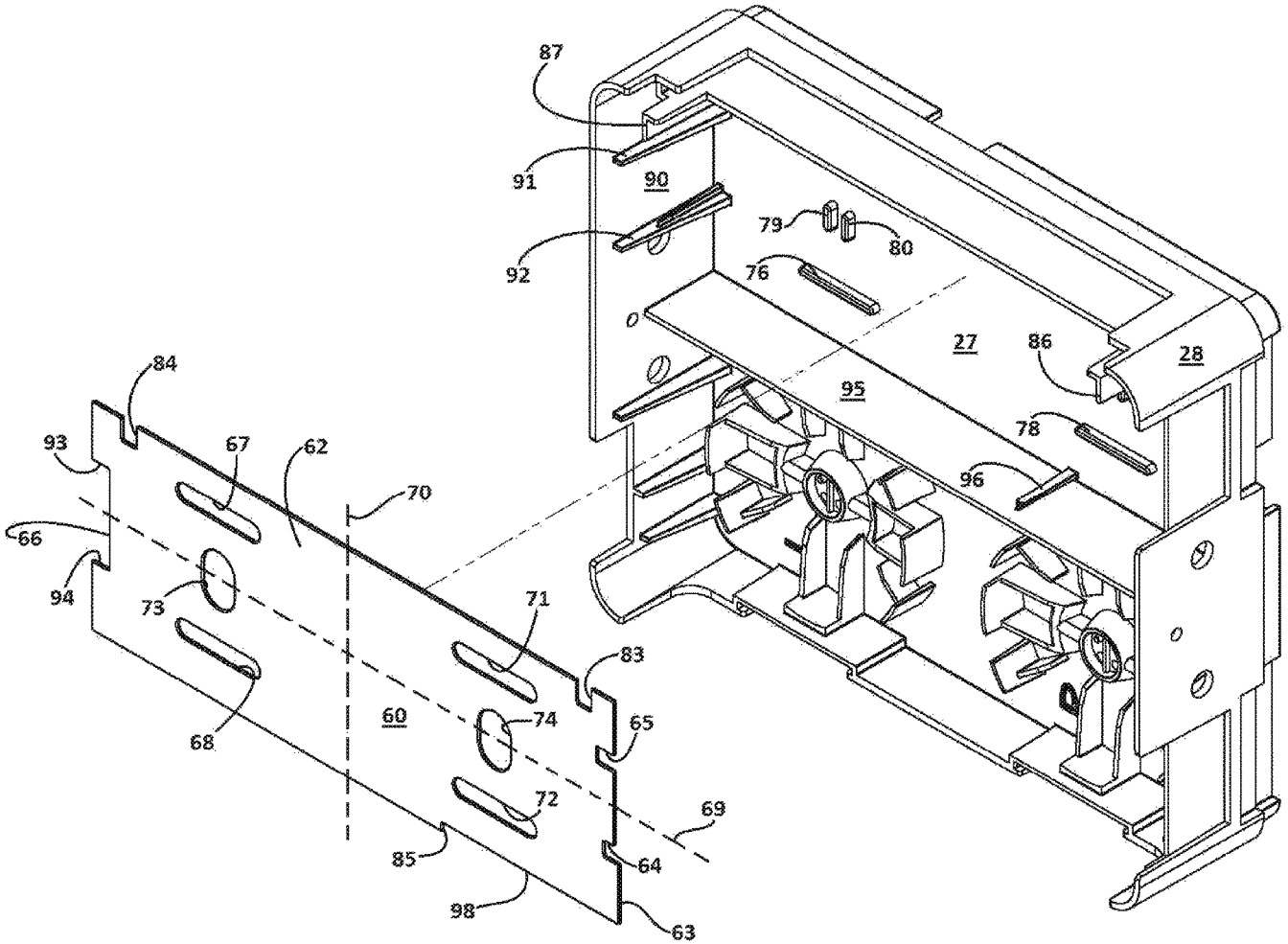
FIG. 13 is an isometric view of an exploded view of the frame pillow mounted in the tray as depicted in FIG. 12, shown without the spectacle frame.

Referring again to FIG. 5 and also to FIGS. 11, 12 and 13, the present invention also includes a frame pillow 60 that is adapted to reside within the tray 28 and support a spectacle lens frame 61. The frame pillow 60 is formed as a substantially rectangular planar sheet 62 having a substantially continuous perimeter 63 that includes a series of perimeter cutout regions, such as cutout regions 64, 65, 66, 83, 84 and 85. The planar sheet 62 is formed to also include a series of symmetrically paired perforations, such as a first pair of perforations consisting of first and second relatively narrow slots 67 and 68 which are symmetrically spaced apart so as to straddle horizontal axis 69. A second pair of perforations are formed as third and fourth relatively narrow slots 71 and 72 which also straddle horizontal axis 69. The first slot 67 is symmetrically spaced apart from third slot 71 so as to surround vertical axis 70 of the planar sheet 62.

A third pair of perforations are formed as first and second relatively wide slots 73 and 74 which are symmetrically spaced apart from the vertical axis 70. The first relatively wide slot 73 resides on the horizontal axis 69 and is equidistant from both the first and second relatively narrow slots 67 and 68, respectively. Similarly, the second relatively wide slot 74 also resides on the horizontal axis 69 and is equidistant from the third and fourth relatively narrow slots 71 and 72, respectively.

The tray floor 27 is formed to include a series of vertical extensions that are adapted to mate with the slots formed in the planar sheet 62. For example, first vertical extension 75 is inserted into the first relatively narrow perforation 67, while second vertical extension 76 is inserted into second relatively narrow perforation 68. Third vertical extension 77 is inserted into third relatively narrow perforation 71 and fourth vertical extension 78 is inserted into fourth relatively narrow perforation 72. A first pair of spaced apart vertical extensions 79 and 80 are both simultaneously inserted into the first relatively wide slot 73, and a second pair of spaced apart vertical extensions 81 and 82 are both simultaneously inserted into the second relatively wide slot 74.

Additional structures formed integrally with and extending from the tray floor 27 further secure the frame pillow 60 to the tray 28. A first column 86 is inserted into left perimeter cutout 83, while a symmetrically spaced second column 87 is inserted into right perimeter cutout 84. A first right edge column 88 is inserted into the first right edge perimeter cutout 65, while a second right edge column 89 is inserted into the second right edge perimeter cutout 64.

The left wall 90 of the tray 28 is formed to include a pair of tapered columns composed of first tapered column 91 and second tapered column 92. The tapered columns 91 and 92 are spaced apart such that when the frame pillow 60 is inserted into the tray 28, the rear edge 93 of the left perimeter cutout 66 is adjacent to the first tapered column 91, while the front edge 94 of the left perimeter cutout 66 is adjacent to the second tapered column 92.

The tray 28 is formed to include a central divider 95. Adjacent to the central divider 95 a pair of tapered columns composed of first tapered column 96 and second tapered column 97 extend outwardly from the tray floor 27. The right perimeter cutout 85 of the planar sheet 62 creates a trailing edge 98. When the frame pillow 60 is inserted into the tray 28, the first and second tapered columns 96 and 97, respectively, are adjacent to the trailing edge 98. Once inserted into the tray 28, the spectacle lens frame 61 is generally constrained within the tray 28. The top edge 101 of the frame 61 is placed into the frame pillow 60 such that at least a portion of the top edge 101 abuts the planar sheet 62 of the pillow 60. At least some portion of at least one of the two bows 99 and 100 of the frame 61 also abuts the planar sheet 62 so as to partially constrain the movement of the frame 61 within the tray 28. The frame pillow 60 may be formed from a vulcanized rubber dispersed in a plastic matrix such as the trademarked material Santoprene.

Various modifications to the invention, in addition to those already described, will be apparent to those of ordinary skill in the art from the foregoing description and accompanying drawings. Such modifications are intended to fall within the scope of the following claims. Further, although some of the embodiments have been described herein in the context of a particular implementation in a particular environment for a particular purpose, those of ordinary skill in the art will recognize that its usefulness is not limited thereto and that the embodiments can be beneficially implemented in any number of environments for any number of purposes. In particular, variations in materials, shapes and dimensions may be employed as required by the object being processed, stored or conveyed.

I claim:

1. A tray assembly comprising:

(a) a tray, the tray being formed to include a substantially planar upper surface, the upper surface being capable of supporting an item placed in the tray, (b) an insert, the insert being rigidly mounted within the tray so as to abut at least a portion of the substantially planar upper surface of the tray, the insert being adapted to receive an object and to support the object in a spaced apart relationship from the substantially planar upper surface of the tray, the insert being composed substantially of a vulcanized rubber dispersed in a plastic matrix adapted to substantially inhibit relative movement between the insert and an object abutting the insert, the insert further comprising:

(i) a substantially circular central opening, the substantially circular central opening being adapted to surround the substantially circular region extending from the substantially planar upper surface of the tray; and (ii) a plurality of radially extending indentations, at least some of the indentations being substantially aligned with substantially planar blades extending from the upper surface of the tray, the radially extending indentations being adapted to mate with the planar blades when the insert is mounted within the tray, and at least some of the plurality of radially extending indentations are radially aligned with another one of the radially extending indentations so as to define a diameter of the insert, wherein some of the plurality of radially extending indentations further comprise:

(A) a plurality of slits, each of the slits being formed integrally with each of the radially extending indentations so to allow separation of adjacent elements of an indentation when one the indentations is placed over a vertical blade extending from the upper surface of the tray; and (B) a plurality of beveled surfaces, each of the beveled surfaces forming an inclined, substantially planar surface abutting a terminal end of each slit, wherein the object abutting the insert is an optical lens, the lens having a surface curvature, the surface curvature causing the optical lens to simultaneously abut a majority of the beveled surfaces residing on the insert;

(c) a plurality of substantially planar blades, each of the blades being integrally formed with the substantially planar upper surface of the tray, wherein each of the blades is substantially orthogonal to the upper surface of the tray;

(d) at least one substantially circular region, the substantially circular region extending orthogonally from the substantially planar upper surface of the tray, the substantially circular region being surrounded by some of the substantially planar blades so as to provide a substantially symmetrical mounting platform; and (e) a plurality of parallel linear indentations, wherein each of the linear indentations forms a pair of linear indentations, each of the pair of linear indentations being equidistant from a diameter of the insert.

2. The tray assembly of claim 1, wherein each pair of linear indentations is substantially orthogonal to at least one adjacent pair of linear indentations.

3. The tray assembly of claim 2, further comprising a frame pillow, the frame pillow being affixed to a portion of the tray so as to define a relatively confined space in which a spectacle lens frame is retained.

4. The tray assembly of claim 3, wherein the frame pillow is composed substantially of a vulcanized rubber dispersed in a plastic matrix adapted to substantially inhibit relative movement between the frame pillow and a spectacle lens.

* * * * *